US008714872B2

(12) United States Patent
Schmidt et al.

(10) Patent No.: US 8,714,872 B2
(45) Date of Patent: May 6, 2014

(54) TRANSVERSE SPREADING ARRANGEMENT FOR A ROAD FINISHING MACHINE

(71) Applicant: Joseph Voegele AG, Ludwigshafen/Rhein (DE)

(72) Inventors: Thomas Schmidt, Plankstadt (DE); Martin Seibel, Bruchsal (DE)

(73) Assignee: Joseph Voegele AG (DE)

( * ) Notice: Subject to any disclaimer, the term of this patent is extended or adjusted under 35 U.S.C. 154(b) by 0 days.

(21) Appl. No.: 13/859,914

(22) Filed: Apr. 10, 2013

(65) Prior Publication Data

US 2013/0272788 A1 Oct. 17, 2013

(30) Foreign Application Priority Data

Apr. 13, 2012 (DE) ..... 20 2012 003 753 U

(51) Int. Cl.
*E01C 19/12* (2006.01)

(52) U.S. Cl.
USPC ..... 404/101; 404/118

(58) Field of Classification Search
USPC ..... 404/101–105, 118
See application file for complete search history.

(56) References Cited

U.S. PATENT DOCUMENTS

| | | | | |
|---|---|---|---|---|
| 4,708,519 | A * | 11/1987 | Davin et al. | 404/101 |
| 4,974,688 | A * | 12/1990 | Helton | 175/73 |
| 5,348,418 | A * | 9/1994 | Campbell | 404/103 |
| 7,407,022 | B2 * | 8/2008 | Mundell et al. | 175/66 |
| 2009/0325818 | A1 * | 12/2009 | Khvorova et al. | 506/16 |

* cited by examiner

*Primary Examiner* — Raymond W Addie
(74) *Attorney, Agent, or Firm* — Brooks Kushman P.C.

(57) ABSTRACT

A transverse spreading arrangement for a road finishing machine includes spreading screws that work in opposite directions, a screw suspension that holds both spreading screws, and two screw bearing brackets that are each allocated to an outer end of a spreading screw. Each screw bearing bracket comprises a closed tube which is at least partially made of wear-resistant steel.

9 Claims, 1 Drawing Sheet

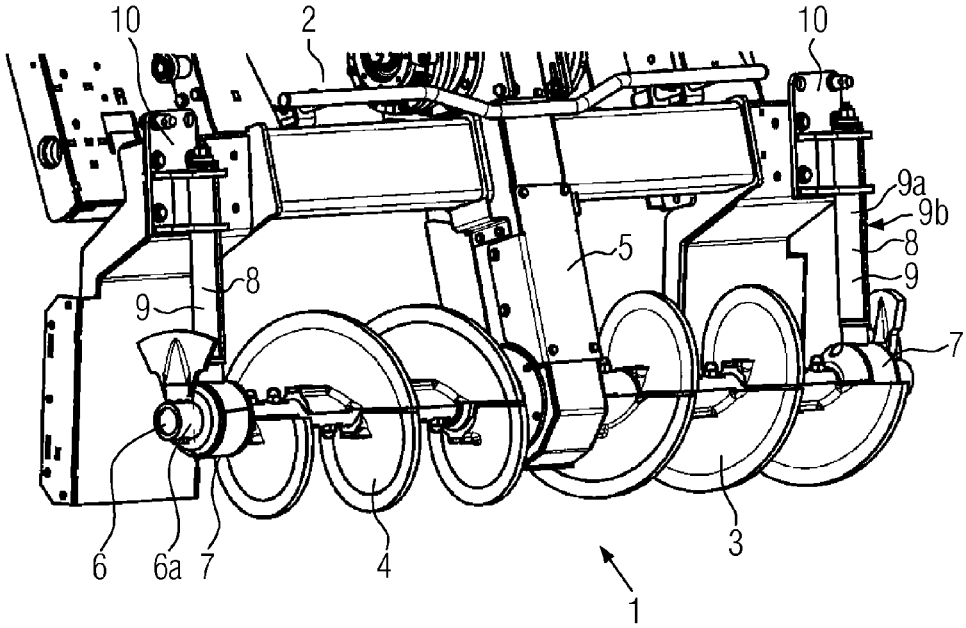
10
2
10
9a
9b
8
9
5
8
9
7
6
6a
7
4
3
1

TRANSVERSE SPREADING ARRANGEMENT FOR A ROAD FINISHING MACHINE

CROSS-REFERENCE TO RELATED APPLICATIONS

This application claims foreign priority benefits under 35 U.S.C.§119(a)-(d) to German patent application number DE 20 2012 003 753.6, filed Apr. 13, 2012, which is incorporated by reference in its entirety.

TECHNICAL FIELD

The disclosure relates to a transverse spreading arrangement for a road finishing machine.

BACKGROUND

Such transverse spreading arrangements are known from practice. They are fixed to the rear end of the chassis of the road finishing machine, that means between the chassis and a screed towed by the chassis. Laying material, for example mixed bituminous laying material, is conveyed onto the transverse spreading arrangement by means of a longitudinal conveyor, also referred to as scraper belt. The task of said arrangement is to spread the mixed laying material in the transverse direction of the road finishing machine, so that the laying material is available over the complete width of the following screed. To this end, the transverse spreading arrangement has two spreading screws, namely a left and a right spreading screw. The two spreading screws work in opposite directions with respect to each other such that they transport the supplied mixed laying material each from the center of the road finishing machine to its outer sides. This working of the spreading screws in opposite directions can be achieved by contradirectional pitches of their threads, so that the spreading screws can still have a common shaft and a common sense of rotation. Moreover, they can still be driven by a common screw drive.

Due to the considerable forces, the outer ends of the spreading screws are usually not mounted freely but each in a screw bearing bracket. Due to the laying material transported against these brackets, considerable abrasive wear occurs at said screw bearing brackets. To increase the service life of the screw bearing brackets, it is known to place wear plates on their inner surfaces which must be exchanged at regular intervals.

SUMMARY

It is an object of the present disclosure to improve the known transverse spreading arrangement for a road finishing machine in view of reduced maintenance efforts.

The transverse spreading arrangement according to the disclosure for transversely spreading laying material at a road finishing machine provides for each screw bearing bracket for mounting a shaft of its associated spreading screw to comprise a closed tube which is at least partially made of wear-resistant steel. "Wear-resistant steel" is defined in the sense of the disclosure as steel having a hardness of at least 300 BHN. Preferably, the hardness of the wear-resistant steel used for the disclosure, however, is at least 400 or even above 500 BHN. As wear-resistant steel, a steel available under the trade name HARDOX® is particularly suited.

It turned out to be advantageous for the tube to be completely made of wear-resistant steel as this further reduces wear and correspondingly extends the maintenance intervals.

It can be advantageous for the manufacture to assemble the tube from two half bowls. Here, the half bowls can be assembled, for example, when the shaft of a spreading screw has already been inserted into one of the half bowls. This configuration would permit to manufacture both half bowls from the same wear-resistant steel. As an alternative, however, it would also be possible for the two half bowls to be made from different materials, where it would in particular be sufficient for only the half bowl facing the screw suspension to be made of a particularly wear-resistant steel.

It would be conceivable to connect the two half bowls with each other detachably. This would permit to exchange the half bowl particularly affected by wear as an expendable part after a certain service life.

As an alternative, the two half bowls, however, could also be permanently fixed to each other. For example, this could be done by welding the two half bowls to each other.

As an alternative to an assembly of the tube from two half bowls, however, it is also conceivable to use an integrally formed tube.

An embodiment of the disclosure offers particular advantages if the two screw bearing brackets used in the transverse spreading arrangement have identical designs. This sameness may not only refer to the two tubes, but can also comprise fastening plates for fastening the transverse spreading arrangement to the chassis of the road finishing machine. The embodiment of the two screw bearing brackets as identical parts or equal parts considerably reduces warehousing efforts as no longer two different screw bearing brackets must be produced and stored. Moreover, problems, such as the return of inappropriate left or right screw bearing brackets, can be avoided.

The maintenance intervals of the transverse spreading arrangement can be further extended by at least one surface of the tube being hardened and/or at least one surface of the tube being provided with a wear-reducing coating.

The disclosure finally also relates to a road finishing machine with a transverse spreading arrangement for mixed laying material according to one of the above-described embodiment variants.

BRIEF DESCRIPTION OF THE DRAWINGS

FIG. 1 is a perspective view of an embodiment of a transverse spreading arrangement according to the disclosure.

DETAILED DESCRIPTION

FIG. 1 shows an embodiment of a transverse spreading arrangement 1 according to the disclosure in a perspective view. This transverse spreading arrangement 1 is fastened at the rear end of the chassis 2 of a road finishing machine.

The transverse spreading arrangement 1 comprises a right spreading screw 3 and a left spreading screw 4 (seen in the direction of motion of the road finishing machine). Both spreading screws 3, 4 are centrically mounted at a screw suspension 5. In the housing formed by the screw suspension 5, there is a screw drive (not represented) for driving the two spreading screws 3, 4.

Each spreading screw 3, 4 has a shaft 6. This can be two individual shafts 6 or one common shaft 6 of the two spreading screws 3, 4. The outer end 6*a* of each shaft 6, i. e. the end facing away from the screw suspension 5, is mounted in a screw bearing 7. Each screw bearing 7 is mounted at the lower end of a screw bearing bracket 8. These screw bearing brackets 8 have an essentially vertically oriented tube 9 which is fastened to the chassis 2 of the road finishing machine by means of a fastening plate 10. The tube 9 is made of wear-resistant steel and preferably has an outer surface that is hardened or provided with a wear-reducing coating.

Each tube 9 is composed of two half bowls 9*a*, 9*b*. Each of the half bowls 9*a*, 9*b* can have a semicircular design, so that the two half bowls are assembled into a tube 9 with a circular diameter. The two half bowls 9*a*, 9*b* can be welded to each other. As an alternative, the tube 9 can be integrally formed.

In the present embodiment, the two screw bearing brackets 8 are formed as equal parts, meaning that they are identical. This does not only relate to the tubes 9, but also to the respective associated fastening plates 10.

In operation, the spreading screws 3, 4 transport mixed laying material to the outer sides of the road finishing machine, in particular to the screw bearing brackets 8.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A transverse spreading arrangement for a road finishing machine, the transverse spreading arrangement comprising:

spreading screws that work in opposite directions;

a screw suspension that holds both spreading screws; and two screw bearing brackets that are each allocated to an outer end of a respective one of the spreading screws, wherein each screw bearing bracket comprises a closed tube which is at least partially made of wear-resistant steel, and wherein each tube is assembled from two half bowls that are detachably connected with each other.

2. The transverse spreading arrangement according to claim 1 wherein the wear-resistant steel is HARDOX® steel.

3. The transverse spreading arrangement according to claim 1 wherein each tube is completely made of wear-resistant steel.

4. The transverse spreading arrangement according to claim 1 wherein, for each tube, the corresponding half bowls are made of different materials.

5. The transverse spreading arrangement according to claim 1 wherein the two screw bearing brackets have identical designs.

6. The transverse spreading arrangement according to claim 1 wherein at least one surface of each tube is hardened.

7. The transverse spreading arrangement according to claim 1 wherein at least one surface of each tube is provided with a wear-reducing coating.

8. A road finishing machine comprising:

a transverse spreading arrangement including spreading screws that work in opposite directions, a screw suspension that holds both spreading screws, and two screw bearing brackets that are each allocated to an outer end of a respective one of the spreading screws, wherein each screw bearing bracket comprises a closed tube which is at least partially made of wear-resistant steel, and wherein each tube is assembled from two half bowls that are detachably connected with each other.

9. The road finishing machine according to claim 8 wherein, for each tube, the corresponding half bowls are made of different materials.

* * * * *